United States Patent [19]

Miller

[11] 4,069,995

[45] Jan. 24, 1978

[54] DYNAMIC COLUMN SUPPORT FOR FEEDER PAN

[76] Inventor: Leland D. Miller, R.R. 1, Tonganoxie, Kans. 66086

[21] Appl. No.: 742,514

[22] Filed: Nov. 16, 1976

[51] Int. Cl.[2] ..... B43L 15/00

[52] U.S. Cl. ..... 248/118.1; 248/388; 248/160

[58] Field of Search ..... 248/118, 118.1, 118.3, 248/160, 371, 204, 387, 388, 389, 392, 176, 188.3, 163, 401, 424; 297/391; 5/327

[56] References Cited

U.S. PATENT DOCUMENTS

| | | | |
|---|---|---|---|
| 75,306 | 3/1868 | Smith | 248/387 |
| 438,279 | 10/1890 | Rowlett | 248/118 |
| 607,675 | 7/1898 | Barr | 248/118.1 |
| 659,089 | 10/1900 | McKinney | 248/388 |
| 1,599,066 | 9/1926 | Rushmore | 248/160 |
| 2,976,000 | 3/1961 | Gunderson | 248/160 |
| 3,465,997 | 9/1969 | Piske | 248/387 |
| 3,646,696 | 3/1972 | Sarkisian | 248/160 |

FOREIGN PATENT DOCUMENTS

| | | | |
|---|---|---|---|
| 1,339,465 | 4/1963 | France | 248/401 |
| 540,714 | 1/1932 | Germany | 248/388 |
| 16,919 | 7/1914 | United Kingdom | 248/118 |
| 516,257 | 12/1939 | United Kingdom | 248/118 |

*Primary Examiner*—Marion Parsons, Jr.
*Attorney, Agent, or Firm*—D. A. N. Chase

[57] ABSTRACT

Apparatus is disclosed for supporting an individual's arm in a feeder pan or tray to enable the user to perform manipulative acts with his hands and fingers without relying upon arm or shoulder muscles. The tray easily moves in any horizontal direction to a desired position within the limits of the apparatus without tipping or tilting. The underlying dynamic suspension which permits this movement includes three or more longitudinally incompressible but laterally deflectable columns positioned at the vertexes of a regular polygon and extending upwardly from a fixed base to a movable table upon which the tray is mounted. Each column is a wire cable having a core element with wire plies counterwrapped thereon in spiral layers.

9 Claims, 4 Drawing Figures

DYNAMIC COLUMN SUPPORT FOR FEEDER PAN

This invention relates to improvements in limb support structures such as feeder pans which are used to support the arm and shoulder while the finger and hand muscles are in use and, in particular, to an improved suspension system to allow a feeder pan or any other type of limb-receiving tray to move freely in any horizontal direction relative to a fixed base while maintaining a desired balanced condition.

A feeder pan is the common term for an arm support used in occupational therapy. It is possible for an individual to have a disability in the upper arm or shoulder muscles which precludes movement of the arm at the elbow or shoulder joints, while having perfectly normal and useful hand and finger muscles. Also artists, typists, writers and others who do manipulative tasks over long periods of time occasionally employ arm support devices to relieve from the upper arm and shoulder muscles.

Traditionally, there are two types of feeder pan devices known by their support systems, dynamic and fixed. A fixed support for the arm-receiving pan or tray may simply take the form of a rigid base of a desired shape and configuration. The problem with fixed support system is that their stationary position severely limits the area in which the hand can be used without moving the fixed support to another stationary position.

Included in the dynamic class of feeder pan devices are those employing an overhead suspension or using a "BFO." The latter stands for "balanced feeder othosis" and is simply a mechanical linkage underlying the feeder pan having various low friction bearings on vertical axes designed to permit movement of the pan in any horizontal direction to a desired position. Although such dynamic supports do provide a range for hand movement, the mechanical linkages that dynamically support feeder pans in the prior art are relatively complicated and cumbersome. Furthermore, the movement of the feeder pan is likely to be jerky and unnatural; this could cause irritation of the arm and shoulder muscles in addition to disturbing the manipulative acts being attempted by the fingers and hand of the user.

It is, therefore, a general object of the present invention to provide a feeder pan or the like with a support system which is relatively uncomplex and overcomes the problems discussed above.

Another important object of the invention is to provide such a support that permits the user to freely move the pan or tray in any horizontal direction in a natural motion without jerking, tipping or tilting the pan, thereby avoiding any dumping tendency.

Still another important object is to provide a support as aforesaid which biases the limb-supporting pan or tray toward a neutral position.

Furthermore, a specific object of this invention is to provide a support of this character that is lightweight, easily carried, but still strong and sturdy for the purpose desired.

Another specific object of this invention is to provide a support as aforesaid that permits the pan or tray to remain in a level attitude while moving to any desired horizontal position.

Still another specific object of this invention is to provide a support as aforesaid that allows the pan to be moved in a horizontal direction with very little vertical displacement.

Yet another specific object of this invention is to provide such a support that employs a suspension system requiring only a few simple components.

More specifically, it is an important object of this invention to provide an underlying dynamic column support system that is deflectable laterally but incompressible vertically.

Another important and specific object of this invention is to provide a column support system as aforesaid employing "sewer snake" type cables of uniform length arranged in a regular polygonal relationship and which are laterally resilient.

DETAILED DESCRIPTION

Figure 1:
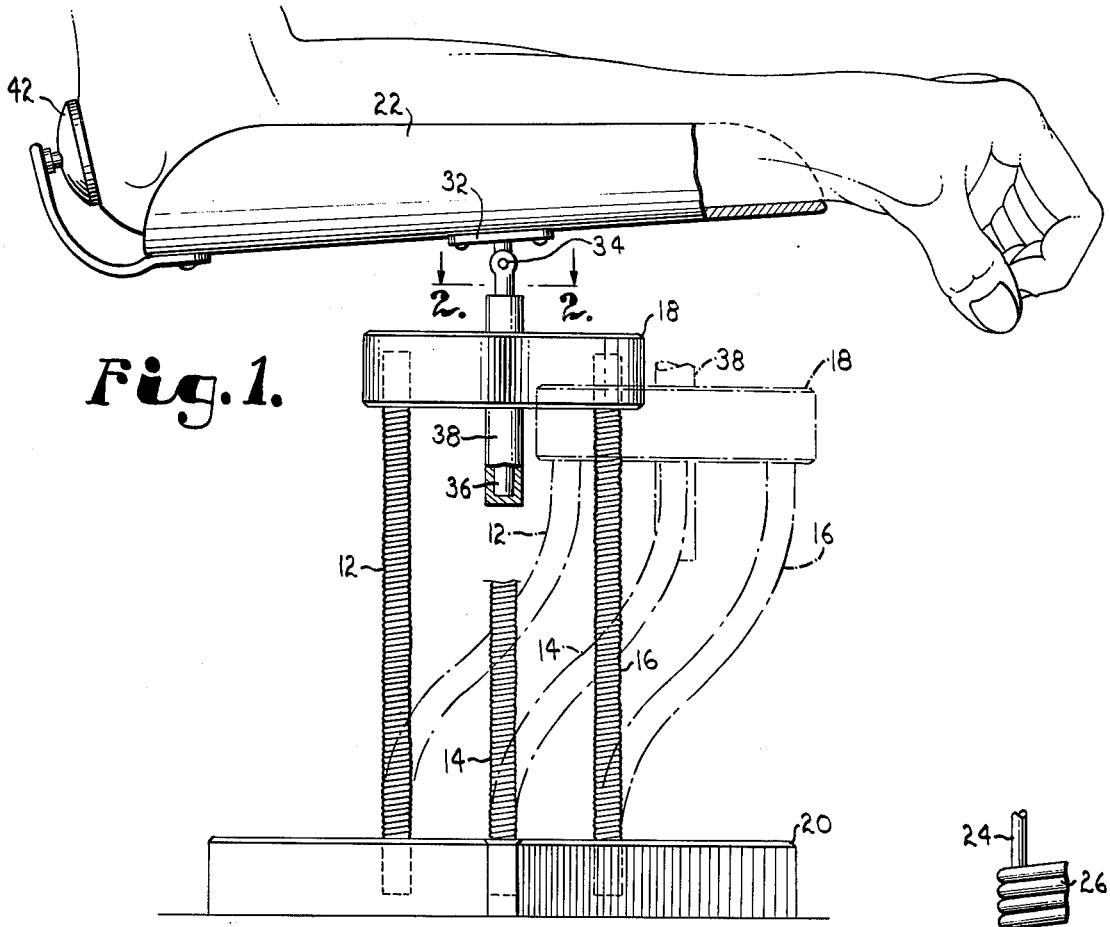
FIG. 1 is a side elevational view of a feeder pan device with the column support of the present invention shown in use, a flexed position thereof being illustrated in broken lines.
Figure 3:
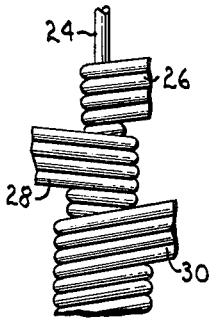
FIG. 3 is a fragmentary detail view of a column illustrating the manner in which the four-wire plies are wrapped around the core in a counterwrapped spiral relationship.
Figure 2:
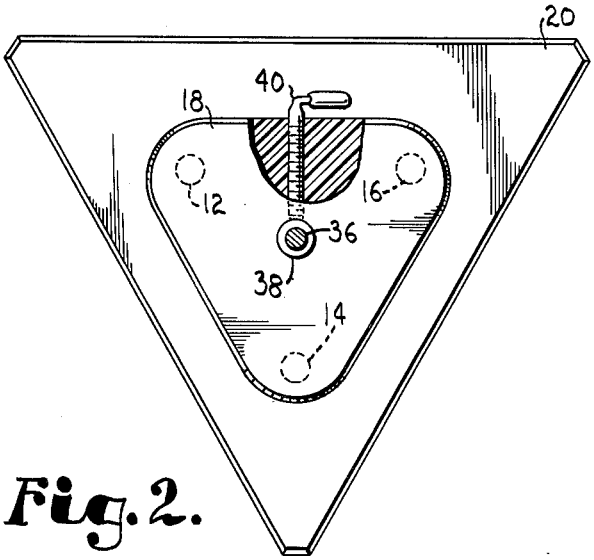
FIG. 2 is a horizontal sectional view taken along line 2—2 of FIG. 1.

The underlying dynamic suspension system for a feeder pan as shown in FIGS. 1–3 has three column members 12, 14 and 16 disposed between a movable table 18 and a stationary, horizontal base 20. The feeder pan or tray 22 is mounted on the table 18 and is disposed thereabove.

As can be best seen in FIG. 2, both the base 20 and the table 18 are essentially triangular in shape and may be contructed from wood, metal or plastic. The table 18 spaced above the base 20 is roughly one-half the size of the base. The respective lower ends of column members 12, 14 and 16 are rigidly secured in normally vertically aligned holes in the table 18 and base 20 bored partially therethrough.

As viewed in a horizontal plane, the three column members 12, 14 and 16 are arranged in an equilateral triangular array (they define the vertexes of such triangle) and provide a laterally deflectable column means that mounts the table 18 in a preferably horizontal attitude in parallelism with the base 20. The column members 12, 14 and 16 are of uniform length and construction and thus the parallel relationship is maintained.

Each of the column members 12, 14 and 16 is a wire cable of the "sewer snake" having a core wire 24 (FIG. 3) and three successive spiral plies of wires counterwrapped around the core wire 24. There are four wires to a ply. The inner ply 26 is wrapped in a spiral around the core wire 24; then center ply 28 encircles inner ply 26 and is wrapped in the opposite direction. The outer ply 30 encircles center ply 28 and is wrapped in the same direction as inner ply 26 to form the counterwrapped configuration. By virtue of such construction, each cable member is laterally deflectable but will not compress longitudinally.

The normal or neutral position of the table 18 relative to the base 20 is shown in full lines in FIG. 1. The column members 12, 14 and 16 yieldably bias the table towards this normal position. Since the column members are laterally deflectable in any direction, the arm tray 22 may be selectively shifted horizontally. The user of the device need only move his arm in a desired horizontal direction to shift the tray 22 and table 18. To then maintain the table 18 displaced from its normal position, the user exerts a small, constant force sufficient to overcome the natural bias of the laterally resilient column members 12, 14 and 16 which seek to return the table 18 to its normal position by spring action. When the table 18 is shifted to any desired horizontal position away from its normal position, the column members 12, 14 and 16 flex as illustrated in broken lines in FIG. 1. Note that the table 18 remains in a horizontal attitude with only minimal vertical displacement when the table is shifted in a horizontal direction.

The tray 22 is provided with an elbow rest 42 which comfortably holds the user's arm, and is positioned above the table 18 by a mounting including a mounting bracket 32 attached to the underside of the arm-receiving tray 22. A pivot pin 34 attaches the mounting bracket 32 to the upper end of an upright stem 36. The pivot pin 34 enables the tray 22 to swing about a horizontal axis to the required orientation.

The stem 36 is received and supported by an upright tube 38 having a closed lower end. A set screw 40 as best seen in FIG. 2 is threaded into a tapped opening in the table 18 and bears against the closed tube, the latter extending through a centrally located hole in table 18. The vertical height of the closed tube 38 can be controlled by relieving the pressure exerted by set screw 40 and moving the closed tube in the desired vertical direction. After this is done, the set screw 40 is once again tightened, thus securely fixing the tube 38 in place by pressure contact. The tray 22 is thereby permitted to swivel in a horizontal plane at the elevation set, since the stem 36 is free to rotate within the tube 38.

Figure 4:
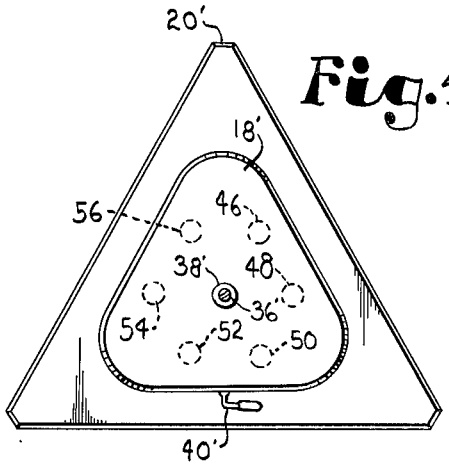
FIG. 4 is a top plan view similar to FIG. 2 of an alternative form of the feeder pan support, on a reduced scale.

An alternative form of underlying dynamic suspension system is shown in FIG. 4 and is essentially the same as that illustrated in FIGS. 1 through 3 except that six column members 46, 48, 50, 52, 54 and 56 in a hexagonal array are used instead of three. In FIG. 4 components corresponding to their counterparts in FIGS. 1 through 3 are denoted by the same reference numerals with the addition of the prime notation. The suspension system in FIG. 4 will support more weight and stiffen the dynamic action, thereby providing increased resistance to horizontal movement.

The length of the column members, the number of counterwrapped spiral layers of wire in each column member and the number of column members are all factors that determine the maximum usable horizontal displacement of the movable table, the amount of weight the support system can accommodate and the relative ease of movement in the desired horizontal direction. Regardless of the number of column members employed, they should be arranged in a regular polygon in order to equally distribute the stress among the members when the table is shifted from the neutral position.

Manifestly, the teachings of the present invention are equally applicable to the support of an individual's leg, particularly in view of the greater weight that can be accommodated by increasing the number of column members.

Having thus described the invention, what is claimed as new and desired to be secured by Letters Patent is:

1. A limb support comprising:

a base;

a table spaced above said base and having a normal position relative thereto;

a tray on said table adapted to receive an individual's limb; and laterally deflectable column means on said base extending therefrom to said table, and including at least three laterally resilient, spaced column members arranged in a polygonal array and mounting the table in a predetermined attitude for movement in any horizontal direction up to a maximum, substantial displacement away from said normal position, said column members being longitudinally incompressible, yieldably biasing said table toward said normal position, and maintaining said table in substantially said attitude as the table is selectively shifted in any desired horizontal direction away from said normal position in a smooth, natural motion with minimum vertical displacement.

2. The limb support as claimed in claim 1, wherein each of said column members includes a core wire element and a plurality of wire plies counterwrapped around said core in successive spiral layers.

3. The limb support as claimed in claim 1, wherein said column members are of uniform length between said base and said table.

4. The limb support as claimed in claim 1, wherein said predetermined attitude is generally horizontal and said table and said base are disposed in substantially parallel relationship.

5. The limb support as claimed in claim 4, wherein said column members are of uniform length between said base and said table.

6. The limb support as claimed in claim 2, wherein said column members are normally upright and parallel to each other.

7. The limb support as claimed in claim 6, wherein said column members define the vertexes of a regular polygon in a plane orthogonal to said members.

8. The limb support as claimed in claim 1, further comprising means mounting said tray on said table for horizontal swiveling motion and for swinging movement about a horizontal axis.

9. The limb support as claimed in claim 8, wherein each of said column members includes a core wire element and a plurality of wire plies counterwrapped around said core in successive spiral layers.

* * * * *

UNITED STATES PATENT OFFICE

CERTIFICATE OF CORRECTION

PATENT NO. : 4,069,995

DATED : January 24, 1978

INVENTOR(S) : LELAND D. MILLER

It is certified that error appears in the above-identified patent and that said Letters Patent are hereby corrected as shown below:

Claim 6:
Column 4, line 43, change "2" to --1--.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*